United States Patent [19]

van der Scheer

[11] Patent Number: 4,542,364

[45] Date of Patent: Sep. 17, 1985

[54] END CAP FOR AN ELECTRIC HIGH VOLTAGE FUSE

[75] Inventor: Derk van der Scheer, Goor, Netherlands

[73] Assignee: Hazemeijer B.V., Hengelo, Netherlands

[21] Appl. No.: 590,573

[22] Filed: Mar. 16, 1984

[30] Foreign Application Priority Data

Mar. 16, 1983 [NL] Netherlands ..... 8300953

[51] Int. Cl.[4] ..... H01H 85/16

[52] U.S. Cl. ..... 337/253; 337/252

[58] Field of Search ..... 337/248, 249, 251, 252, 337/253, 254, 246, 247

[56] References Cited

U.S. PATENT DOCUMENTS 3,644,861 2/1972 Fister ..... 337/252

FOREIGN PATENT DOCUMENTS 828883 1/1952 Fed. Rep. of Germany .
2104814 7/1971 France .
7802199 2/1978 Netherlands .
8006084 7/1980 Netherlands .
205654 1/1938 Switzerland .
1114804 5/1968 United Kingdom .

*Primary Examiner*—Harold Broome
*Attorney, Agent, or Firm*—Watson Cole Grindle & Watson

[57] ABSTRACT

A tubular shaped high voltage fuse, with a support tube of insulating material, having applied thereon parallel fuse conductors, and an outer tube of insulating material, surrounding the support tube. The end cap consists of a cup-shaped electrically conducting cap to be placed upon the ends of the support tube and the outer tube, a tore-shaped, closed helical contact spring of electrically conducting material to be placed around the support tube end for connecting the fuse conductors with the cap and a spacing piece of insulating material having resilient strips connected therewith for compensating tolerance deviations and for centering, together with the helical spring, the support tube within the outer tube.

17 Claims, 9 Drawing Figures

END CAP FOR AN ELECTRIC HIGH VOLTAGE FUSE

The invention relates to electric tubular shaped high voltage fuses, preferably filled with sand, and comprising at least one first support tube of electrically insulating material, having applied thereon parallel fuse conductors running between its ends and an outer tube of electrically insulating material, surrounding the support tube, and in particular to end caps for such fuses.

End caps for such tubular fuses are known from the Dutch laid open Patent Application No. 7802199. The end cap schematically shown here, consists of a round disc, fastened on the outer tube ends. This disc comprises a central opening, through which a contact rod extends to the exterior of the tube, the inner end of which is connected to an electrically conducting plate, supported by the inner wall of the disc. This plate is fastened again to the end of the support tube with the contact ribbons.

The connection between this plate and the electrically conducting contact ribbons on the support tube can be brought about by usual methods by soldering. See for instance Dutch laid open Patent Application No. 8006084. Also screw clamps are used.

A disadvantage of a soldered connection is ageing, amongst other things caused by constant changes of the temperature. These constant temperature changes also result in mechanical tensions because of differences in the coefficient of expansion of the material of the outer tube and of the support tube, which differences hardly can be compensated for by the construction of the end cap. Also such known end caps do not or hardly accept tolerance length deviations, which often appear to exist after the fabrication of the outer tube and support tube, which tolerance deviations in particular in case of several concentric support tubes can be very disadvantageous. Moreover soldered connections are time-consuming and involve the danger of solder fusing in case of high temperatures at the location of these soldered connections.

An object of the present invention is to provide an end cap as stated above, in which the said disadvantages are avoided.

The fuse of the present invention is characterized by:

(a) a cup-shaped cap of electrically conducting material, closed in one of its ends, the open end of which can be slipped over one end of the outer tube and can be fixed thereupon;

(b) a first tore-shaped, closed contact spring of good electrically conducting and resilient material, which can be pushed between the outer wall at one end of the support tube, in electrical contact with the fuse conductors, and the inner wall of the end cap, which contact spring is dimensioned such, that after the end cap has been mounted, the center line of the support tube mainly will be kept coinciding with the center line of the outer tube;

(c) a spacing piece, consisting of a lid placed on the open end of the support tube, which lid comprises resilient strips at its side facing away from the support tube and extending from this side, which strips, after the end cap has been placed on the opened end, are resiliently deformed when in contact with the wall of the closed cap end, pressing this lid against the support tube.

In the fuse of the present invention, using contact springs between the support tube and the cap, soldered connections can be omitted. The tore-shaped helical spring of good electrically conducting and resilient material is of advantage here because of the large number of contacts obtained by the large number of windings of such springs. This contact spring also easily compensates for tolerance deviations and accepts differences in expansion between the concentric parts. The electrical contact with the fuse conductors will be improved even in case these fuse conductors at the support tube ends join electrically conducting collars.

The fuses of the present invention comprises a small number of different parts, by means of which, however, a large number of different embodiments can be assembled having several concentric support tubes, in which neither disadvantages tolerance problems will appear. The assembling process is very simple and can take place very quickly in particular by the omission of soldering connections.

Preferably the cap is shaped as a cylindrical cup, having a broadened portion at the open end with respect to the remaining portion at the closed bottom end. This broadened portion preferably will slidingly fit over the end of the outer tube, until the end edge of the outer tube abuts against the radially extending connection wall between the two cylindrical cap portions having different diameters. The support tube then extends within the narrow cylindrical portion of this cap, which also is in electrical contact with the contact spring. In order to fix the cap on the outer tube the end edge of the open end of this cap can be folded inwardly in a ring groove of the outer tube. Preferably a ring of resilient material will be placed between the folded edge of the cap and the bottom wall of this ring groove, so that a good oil- and water-tight connection is obtained and damage of the outer tube is prevented.

For fuses of relatively low nominal currents, having outer tubes of small diameter, the cap can be of the same diameter over its whole length, comprising an inner inwardly extending rail abutting against the outer tube end edge.

Also rings of resilient material can be placed between the end edges of the outer tube and of the support tube on the one hand and the opposite edges of the cap on the other hand.

The function of the spacing piece is keeping the support tube in its correct position within the outer tube, but also compensating for the differences in expansion by changing temperatures. This spacing piece preferably comprises an axially running ring wall, connected with the radially running lid wall, which upon assembling the end cap can be slipped over the end of the support tube. This ring wall runs preferably according to a quadrangle, in which the end of the support tube slidingly fits between the approximately straight sides of the quadrangle and the cap fits over the corners of this quadrangle. This also serves to maintain the support tube within the cap and the outer tube in center position. The resilient strip of the spacing piece preferably starts from the ring wall near the corners of the quadrangle and are directed to one another. After the assembling process of the end cap the bottom of the cap presses on the free ends of these resilient strips.

In case several coaxial support tubes are used also a resilient contact ring will be placed each time between the outer wall at each end of the further support tubes and an opposite electrical conducting wall. This opposite wall can be formed by a cylindrical portion of the cap, by an additional cylindrical extension piece for this cap or by a metallized inner wall of a support tube coaxially placed about the other.

The resilient rings located between the end edges of the support tubes and the opposite transverse wall may comprise notches extending inwardly, so that the passages between these notches offer the possibility to fill the fuses completely with sand.

The invention now will be further explained on the basis of a number of embodiments of end caps and belonging parts as shown on the drawings.

Figures 1, 2, 3, 4:
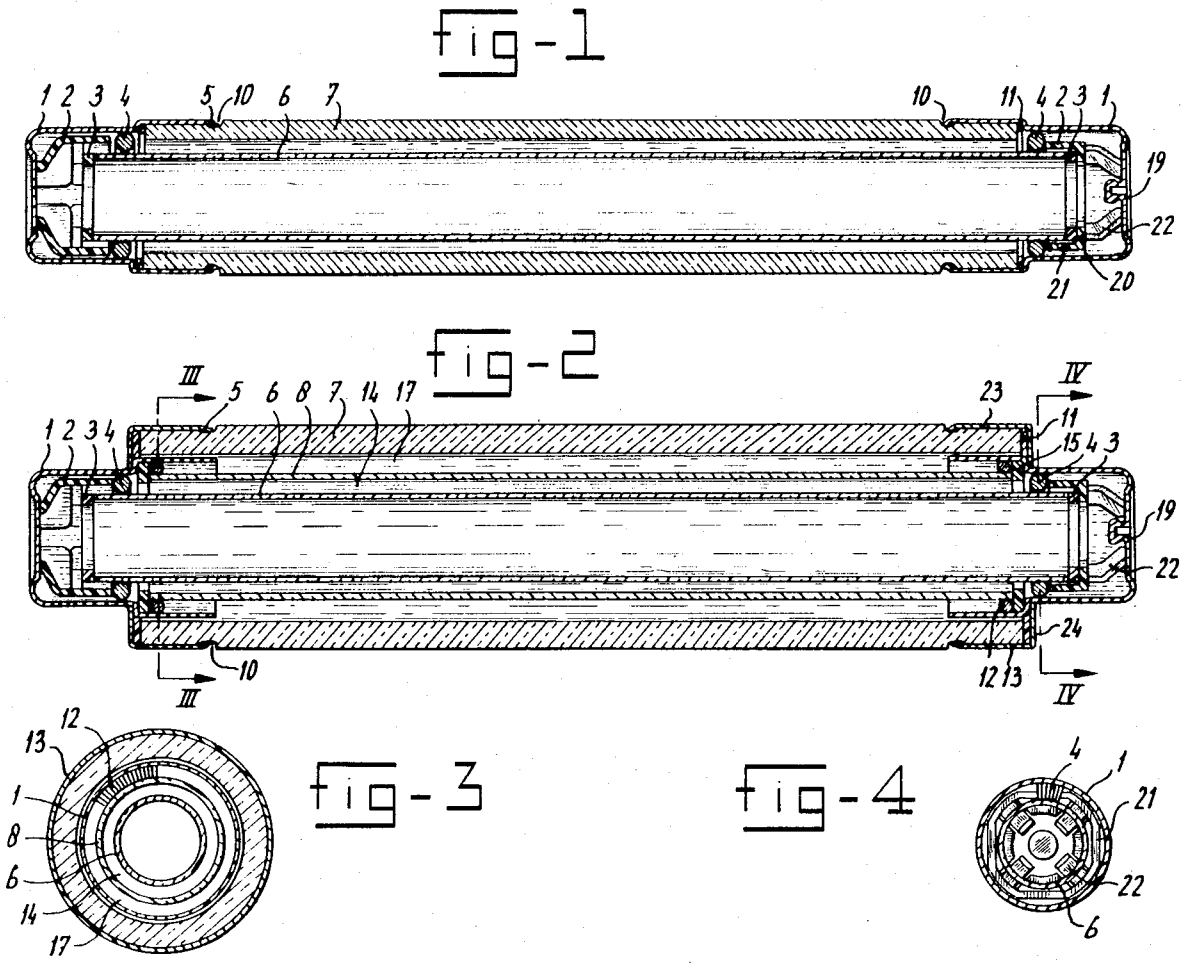
FIG. 1 shows a fuse comprising one support tube.
FIG. 2 shows a fuse comprising two concentric support tubes.
FIG. 3 shows a cross section along line III—III in FIG. 2.
FIG. 4 shows a cross section along line IV—IV in FIG. 2.

The high voltage fuse of FIG. 1, comprising one support tube 6, is suitable for nominal currents, with a maximum of 40 amperes for instance.

The support tube 6 can be of the type as described in the above mentioned Dutch Patent Application No. 7802199 of Applicants, consisting of a support tube of quartz glass, upon which a pattern of electrically conducting strips and if necessary electrically conducting end collars are applied.

The support tube 6 is surrounded by an outer tube 7, preferably of porcelain or glass enforced epoxy resin. A metal cap 1 of sheet material is placed on both ends of this porcelain outer tube 7. This cap 1 is cup-shaped and comprises two cylindrical portions having different diameter, the part having the smallest diameter being closed by a bottom. The part with the largest diameter is slid fittingly over one end of the cylindrical porcelain outer tube 7. At each of the ends of the porcelain outer tube 7 a ring groove 10 is applied for fastening each cap 1 oil- and water-tight on the belonging end of the outer tube. The front edge of the slid over cylindrical cap has been folded inwardly within this ring groove 10, after placing in this groove a resilient tightening and protecting ring 5, for instance made of rubber.

Upon sliding the cap 1 over the end of the porcelain tube 7 the inwardly extending part of the wall between the two cylindrical portions of cap 1 with different diameter eventually will abutt against the front edge of tube 7. Here also a resilient ring 11 is used mainly as tightening means and for compensating axial tolerances, but also to protect the front edge of tube 7. Ring 11 also may be a rubber ring. Upon folding the front edge of cap 1 at 5, this ring 11 will be tightly clamped between the front edge of the porcelain tube 7 and the bent in edge of cap 1.

The support tube 6 which can be of above said type, is supported at both ends by a contact spring 4, consisting of a tore-shaped closed helical spring, for instance of beryllium copper. Upon rotatingly slipping the cap 1 on the end of the support tube 6 the windings of these contact rings 4 will be set at an angle, so that notwithstanding their tolerance-insensibility an extremely good contact is obtained between the fuse conductors on the support tube 6 and the inner wall of the narrow cylindrical portion of cap 1. By using a conducting collar around each end portion the contact with the fuse conductors can be largely improved.

Figure 6:
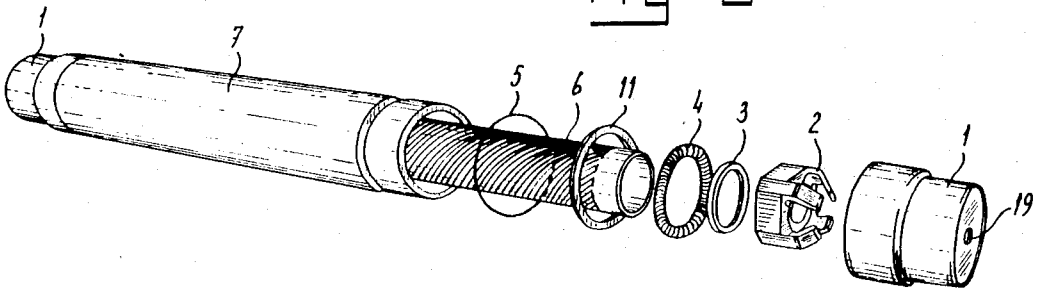
FIG. 6 shows in perspective view the fuse of FIG. 1 with disassembled end cap.
Figure 7:
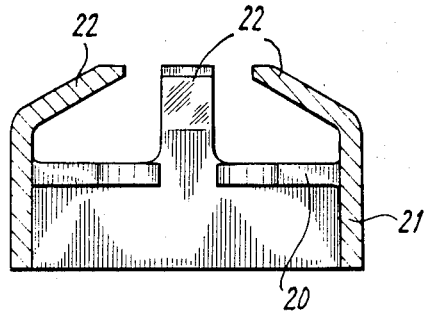
FIG. 7 shows a cross section of a spacing piece.
Figure 8:
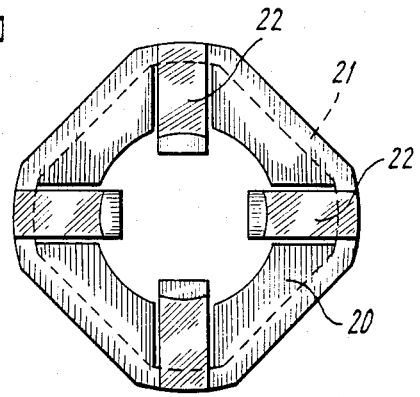
FIG. 8 shows an elevation of the spacing piece of FIG. 7.

Further on each end of the support tube 6 a spacing piece 2 is placed, shown more detailed and with enlarged scale in FIGS. 7 and 8. This spacing piece 2 may consist of plastic material and its function mainly is axially centering and tolerance compensating the support tube 6 within the outer tube 7. The radially centered position is reached by means of the helical contact springs 4. The spacing piece 2 here comprises, a lid having inwardly extending walls 20, forming a bottom with a central filling opening, see also FIGS. 7 and 8. These walls 20 form a moulded, for instance injection moulded, integral part with the ring wall 21 extending downwards and shown in FIG. 7 and the bevelled resilient strips 22 extending upwards. As shown in FIGS. 1 and 6 the spacing piece upon assembling is slid over one end of the support tube 6. An elastic ring 3 is located again between the bottom 20 and the front edge of the support tube 6, to protect the front edge of the support tube. Strips 22 are located in the corners of a quadrangle formed by ring wall 21, see also of FIG. 8. This quadrangle is of such dimensions, that it fits with its corners between the narrower cylindrical portion of cap 1, whereas the middle of each inner side wall surface of this quadrangle presses upon the outer surface of the support tube 6, see also the cross section of FIG. 4.

In the middle of the bottom in the cap 1 a filling opening is made, which can be closed in a gas-tight manner by means of a so-called pulling nail 19. Through this opening the fuse can be filled completely with quartz sand. This sand will reach from between the windings of contact spring 4 also space 14 between support tube 6 and outer tube 7.

The fuse shown in FIG. 2 comprises a second concentric support tube 8, located between the first support tube 6 and the porcelain outer tube 7. This fuse is suitable for higher nominal currents, with a maximum of 80 amperes for instance. Here the same reference numbers are used for corresponding parts as in FIG. 1.

The first support tube 6 is supported in the same way by the end cap as in FIG. 1. Additional space is formed here for the second support tube 8 by using an outer tube 7 having a larger diameter than in FIG. 1. However, the end cap 1 is mainly of the same embodiment as in FIG. 1. The cylindrical portion of this cap 1 having the larger diameter, which in FIG. 1 is slid over the outer tube 7 and fixed hereupon, now is used for supporting the second support tube 8. This is brought about using a second contact spring 12, which preferably also exists of a tore-shaped, closed helical spring. Now this spring is clamped between the fuse conductors or collar near the end of the second support tube 8 and the broader cylindrical part of cap 1. A resilient spring 15 is placed between the end of this second support tube 8 and the transverse radial connection wall, connecting the two cylindrical portions of the cap 1 with one another, in order to protect the end edge of the support tube, but mainly to compensate for tolerance deviations between longitudinal dimensions of the first support tube 6 and the outer tube 7, but also as far as the cap dimensions are concerned.

However, for connecting the outer tube 7 additional provisions are made here with respect to the embodiment of FIG. 1. These provisions comprise a ring-shaped cylindrical portion 13, which can be soldered to the cap 1 with hard-solder or welded and which likewise is formed from sheet metal. This part 13 comprises an axial cylindrical part 23 and a radial flat ring-shaped part 24. This last part is soldered or welded with its inner edge to the cap 1, in which preferably it bears upon the radial connecting portion between the two cylindrical portions of cap 1. The central opening in the ring-shaped radial flat part 24 is a bit larger than the diameter of the small cylindrical portion of cap 1. Again a ring 11 of elastic material is placed between this flat portion 24 and the front edge of the outer tube 7.

Figure 9:
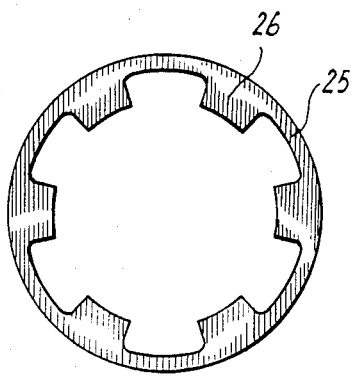
FIG. 9 shows a resilient ring.

Rings 15 of special shape are used, one of which is shown in FIG. 9, to fill the cylindrical space 14 between the two support tubes 6 and 8 but also the cylindrical space between the outer tube and the second support tube 8 with sand.

This ring consists of a relatively thin rim 25 with integrally formed notches 26 extending inwardly. These notches 26 can be of such length, that their inner ends in FIG. 2 extend until adjacent the outer surface of the first support tube. However, it is sufficient when the notches 26 will keep the contact spring 4 in place. Recesses between the notches 26 of this ring 25 provide sufficient space for passing sand upon filling the cylindrical spaces between the support tubes 6 and 8.

This rim can be that thin, that the recesses between the notches run radially outwards, beyond the outer surface of the second support tube 8. Now also the cylindrical space between this second support tube 8 and the outer tube 7 can be filled with quartz sand.

FIGS. 3 and 4 show respectively a cross section through the left-hand portion of the fuse according to FIG. 2 along the lines III—III and through the right-hand portion of the fuse of FIG. 2, along the line IV—IV.

In these FIGS. 3 and 4 the same reference numbers refer to corresponding parts as in FIGS. 1 and 2.

In FIG. 3 the reference number 12 refers to a contact spring made of a helical spring. In the same way the reference number 4 refers in FIG. 4 to the contact spring, keeping the first support tube 6 in position. Also FIG. 4 shows in the same way the ring strap or ring wall 21 of the spacing piece, in its corners bearing upon the inner wall of the narrow cylindrical portion of cap 1, and with the middle of each straight inner side 21 in connection with the outer surface of the support tube 6.

Figure 5:
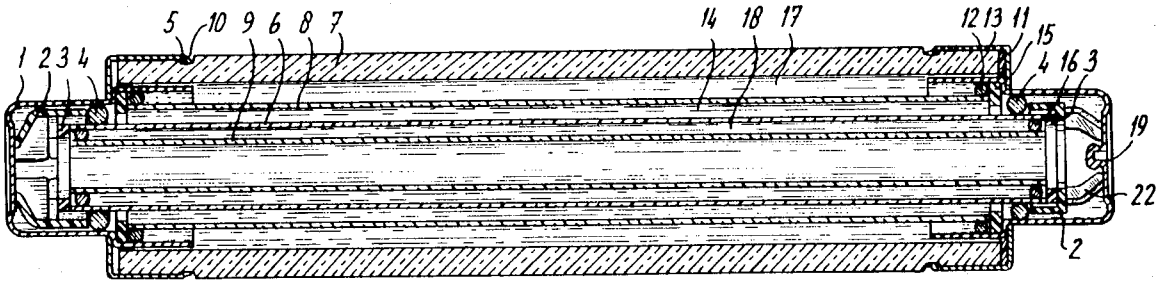
FIG. 5 shows a fuse having three concentric support tubes.

FIG. 5 shows eventually a fuse having an end cap of the present invention, comprising a further support tube 9 and suitable for still higher nominal currents, for instance 125 amperes.

This further support tube 9 is supported now by the first support tube 6 by adding at the ends intermediate contact springs 16, also consisting of tore-shaped closed helical springs. To obtain an electrical contact with the end cap the inner wall of the first support tube 6 at its end should comprise an electrically conducting lining, which moreover is in electrical contact with the electrically conducting collar of fuse conductors at the outer wall of the first support tube 6.

Rings 3, clamped between the ends of the first support tube 6 and the bottom wall 20 of the spacing piece 2 preferably also are shaped as shown in FIG. 9, having inwardly extending notches 26. The recesses between these notches have to extend outwardly, beyond the outer surface of the further support tube 9 located within the first support tube 6, so that the cylindrical space between this second support tube also can be filled with sand. The inwardly extending parts of notches 26 will keep the further support tube 9 axially in place. Tolerance deviations between the two concentric support tubes 6 and 9 are compensated again by the resiliency of these rings 3.

FIG. 6 shows a fuse of FIG. 1, in which the component portions, mainly of the end cap, are placed apart. This Figure also shows clearly the shape of the different component portions. As a matter of course no specially formed ring according to FIG. 9 need be used here, however, this would be possible with ring 11. In the latter case the contact spring 4 would be kept in place by the inner ends of the notches.

Upon assembling the end cap, first the spacing piece 2 is placed within cap 1. Next and in succession ring 3, contact spring 4 and ring 11 are mounted, whereafter the support tube 6 can be slid within the contact spring by rotational movement thereof. Hereafter ring 5 is placed in groove 10 of the porcelain tube 7 and also slid in cap 1. At the other end of the support tube 6 and outer tube 7 now also in succession ring 11, contact spring 4 and ring 3 are mounted and the spacing piece 2 placed thereupon. After bringing ring 5 in groove 10 of the outer tube 7, cap 1 is slid over the end of the two tubes with a rotational movement and then both caps 1 are connected to the outer tube 7 by folding the edge of cap 1 in groove 10. This assembling process is very simple and can be carried out very quickly, in which solder connections are avoided completely. The fuse thus obtained can be filled with quartz sand through the opening in the cap bottom, after which this opening is closed by means of a pulling nail 19.

As a matter of course the invention is not limited to the shown three embodiments, but amendments and additions are possible without departing from the scope of the present invention. For instance a fourth support tube could be mounted between the further support tube 9 which fourth support tube in the same way as shown in FIG. 5 can be electrically contacted by means of a contact spring with an inner lining of the further support tube 9. A further support tube located at the outside of support tube 8 could be placed about the large cylindrical portion of cap 1 by means of contact springs. In that case the ring-shaped portion 13 should comprise a broader flat portion 24, in order to house the further contact spring and the outer tube 7 as well.

I claim:

1. A tubular-shaped high voltage fuse, adapted to be filled with sand, comprising at least one first support tube of electrically insulating material, having applied thereon parallel fuse conductors running between the ends thereof, and an outer tube of electrically insulating material, surrounding said support tube, comprising:

(a) a cup-shaped end cap of electrically conducting material, closed at one of its ends, the open end of which can be slipped over one end of said outer tube and can be fixed thereupon;

(b) a first tore-shaped, closed contact spring of electrically conducting and resilient material, which can be placed between the outer wall at one end of said support tube, in electrical contact with said fuse conductors and the inner wall of said end cap, said contact spring is dimensioned such, that after said end cap has been mounted, the center line of the support tube mainly will be kept in coincidence with the center line of said outer tube; and (c) a spacing piece, comprising a lid to be placed on the open end of the support tube, said lid includes resilient strips at its side facing away from said support tube and extending from said side, which strips, after said end cap has been placed on the open end, are resiliently deformed when in contact with the wall of said closed cap end, pressing said lid against said support tube.

2. A fuse as claimed in claim 1, wherein said end cap is mainly of cylindrical shape having a broader portion at said open end with respect to the remaining portion, such that said broader portion can slidingly fit over the end of said outer tube, until the end edge of said outer tube abuts against the radially extending connection wall between the two cylindrical portions with different diameter.

3. A fuse as claimed in claim 2, wherein said support tube extends within the narrow cylindrical portion of said end cap, said contact spring being located between said narrower portion and said support tube.

4. A fuse as claimed in claim 2, further comprising a ring of resilient material, located between said end edge of said outer tube and said radially extending connection wall of the cap.

5. A fuse as claimed in claim 1, 2, 3 or 4, wherein, for fixing said end cap on said outer tube, the end edge of said open end of said cap is folded inwardly in a ring groove of said outer tube.

6. A fuse as claimed in claim 5, further comprising a ring of resilient material located between the folded edge of said end cap and the bottom wall of said ring groove in said outer tube.

7. A fuse as claimed in claim 1, 2, 3 or 4, further comprising a ring of resilient material, located between the end edge of said support tube and a radially extending lid wall of a spacing piece.

8. A fuse as claimed in claim 7, further comprising a spacing piece comprising an axially extending ring wall, connected with said radially extending lid wall, said ring wall, upon assembling the end cap, can slide over one end of said support tube.

9. A fuse as claimed in claim 8, wherein said ring wall of the spacing piece extends approximately in a quadrangularly shaped member, in which the end of said support tube slidingly fits between the approximately straight sides of said quadrangularly shaped member and said end cap slidingly fits over the corners thereof.

10. A fuse as claimed in claim 8, wherein the resilient strips of said spacing piece extend from angles of the ring wall, formed as a quadrangularly shaped member, and said resilient strips are directed toward one another.

11. A fuse as claimed in claim 1, 2, 3 or 4 having a second support tube with fuse conductors, said second support tube being placed coaxially around said first support tube, and further comprising:

(a) a further cylindrical wall, connected to said end cap and extending coaxially with respect to said first-mentioned cylindrical wall near the open end of said end cap, in which the distance between the two cylindrical walls is sufficient for accepting one end of said outer tube in the ring-shaped space thus formed, in which the outermost cylindrical wall slidingly fits around the end of said outer tube and is fixed thereon; and (b) a second contact spring of electrically conducting resilient material, which can be slid between the outer wall of one end of said second support tube, in electrical contact with the fuse conductors and the inner surface of a cylindrical wall of the cap, said second contact spring is dimensioned such that, after assembling said end cap, the center line of said second support tube is kept mainly coincident with the center line of said outer tube.

12. A fuse as claimed in claim 2, wherein said second support tube does not extend beyond the radially extending connection wall of said end cap, and that said second contact spring is located within the broadened cylindrical portion of said end cap.

13. A fuse as claimed in claim 11 further comprising a ring of resilient material, located between the end edge of said second support tube and the radially extending connection wall between the two cylindrical parts of said end cap.

14. A fuse as claimed in claim 11 having a further support tube with a fuse conductor, located coaxially within said first support tube, further comprising a further contact spring of electrically conducting material, located between the outer wall of said further support tube near an end thereof and the inner wall of said first support tube near an end thereof, said inner wall of said first support tube comprises an electrically conducting lining in electrical contact with the fuse conductors at the outer wall of said first support tube.

15. A fuse as claimed in claim 4, wherein said ring of resilient material comprises inwardly extending notches, the ends of which form a support for a further support tube, and passages are formed between said notches beyond said ring to the outer surface of said further support tube, thereby enabling the intermediate space between said first and further support tubes to be filled with sand.

16. A fuse as claimed in claim 11, wherein said second support tube does not extend beyond the radially extending connection wall of said end cap, and that said second contact spring is located within the broadened cylindrical portion of said end cap.

17. A fuse as claimed in claim 12, further comprising a ring of resilient material, located between the end edge of said second support tube and the radially extending connection wall between the two cylindrical parts of said end cap.

* * * * *